US006497334B1

(12) United States Patent
Scheindel

(10) Patent No.: US 6,497,334 B1
(45) Date of Patent: Dec. 24, 2002

(54) PACKAGING OF NOZZLE FOR PRESSURIZED DISPENSING CONTAINERS

(76) Inventor: Christian T. Scheindel, Cushing Blvd. P.O. Box 58, Bethel, VT (US) 05032

( * ) Notice: Subject to any disclaimer, the term of this patent is extended or adjusted under 35 U.S.C. 154(b) by 0 days.

(21) Appl. No.: 09/974,336

(22) Filed: Oct. 9, 2001

(51) Int. Cl.[7] ..... B65D 23/12
(52) U.S. Cl. ..... 215/390; 222/638; 220/729
(58) Field of Search ..... 215/390, 391, 215/399; 220/744, 729; 222/538

(56) References Cited

U.S. PATENT DOCUMENTS 784,830 A * 3/1905 Beistle ..... 215/390
4,867,332 A * 9/1989 Mains ..... 206/372
5,788,129 A * 8/1998 Markos ..... 222/538
6,315,152 B1 * 11/2001 Kalisz ..... 215/390

* cited by examiner

*Primary Examiner*—Henry C. Yuen
*Assistant Examiner*—Melvin A. Cartagena
(74) *Attorney, Agent, or Firm*—Reed Smith LLP

(57) ABSTRACT

The nozzle for a pressurized container is mounted to the container for shipment and sale by a hook member. The hook member has a hook portion that mounts to the valve cup rim or container rim. An attachment leg connects the hook portion to the nozzle. The hook portion has a slip-fit relationship to the rim on which it is placed. The wall of the hook portion that rests along the outside of the rim is thinner than is the wall that rests along the inside of the rim. This arrangement accommodates the over-cap without displacement or flaring of the nozzle.

9 Claims, 3 Drawing Sheets

PACKAGING OF NOZZLE FOR PRESSURIZED DISPENSING CONTAINERS

BACKGROUND OF THE INVENTION

This invention relates to a technique for assembling or packaging of the nozzle that accompanies a pressurized dispensing container; often called aerosol containers. Many of these dispensing containers, such as those used to dispense caulk, require a separate nozzle to extend the normal valve nozzle. Although the device is a nozzle extension, it is generally referred to in the art as a nozzle.

These nozzles are typically taped to the outside of the dispensing container so that when shipped, the dispensing container will have an appropriate nozzle. The purchaser purchases the container and nozzle as a unit.

The taping is somewhat unsightly and looks ad hoc. In addition, the tape can sometimes be damaged or come loose. Even if the tape does not come off entirely, the nozzle will appear to be hanging on to the container giving the product a crude or low-tech appearance.

Associating the nozzle with the container has been approached over the years in a number of ways. One approach was to pre-mount the nozzle on the valve and build an over-cap large enough to contain the nozzle. This provided a much larger and somewhat more expensive product and was also more expensive to ship and store.

Another technique used and dropped employed a ring around the cup to which the nozzle was detachably attached.

One other approach that was tried was to build a compartment into the over-cap to hold the nozzle. Like the technique of mounting the nozzle on the valve which required a larger over-cap, this also meant a larger and more expensive package.

Accordingly, the object of this invention is to provide a technique and structure for associating and mounting the nozzle to each dispensing container in a fashion that provides security for the nozzle and at a cost which is sufficiently lower so that it will be a cost effective replacement for current techniques.

A related and important purpose of this invention is to provide an appearance for the packaged nozzle and container that is commensurate with the quality of the product being employed.

BRIEF DESCRIPTION

In brief, this invention employs a hook member which is molded to the base of the nozzle and extends radially outward from that base. The hook member has an outboard hook portion and a leg that connects the hook portion to the base of the nozzle. The hook portion is designed to hook over either the rim of the valve cup or at the rim of the can with a slip-fit relationship. The side of the hook which is on the outside of the valve cup rim or can rim is thinner than the side of the hook on the inside of the rim so that the over-cap will fit over the thinner side of the hook without applying pressure to the hook member which would tend to cause the nozzle to flare and thus not hang straight down the side of the can.

The leg of the hook that connects to the base of the nozzle has a small opening adjacent to the base so that the hook member can be readily detached from the nozzle by the user when the nozzle is to be used to dispense material from the pressurized container.

BRIEF DESCRIPTION OF THE DRAWINGS

FIG. 2 shows the over-cap.

DESCRIPTION OF THE PREFERRED EMBODIMENTS

Figure 1:
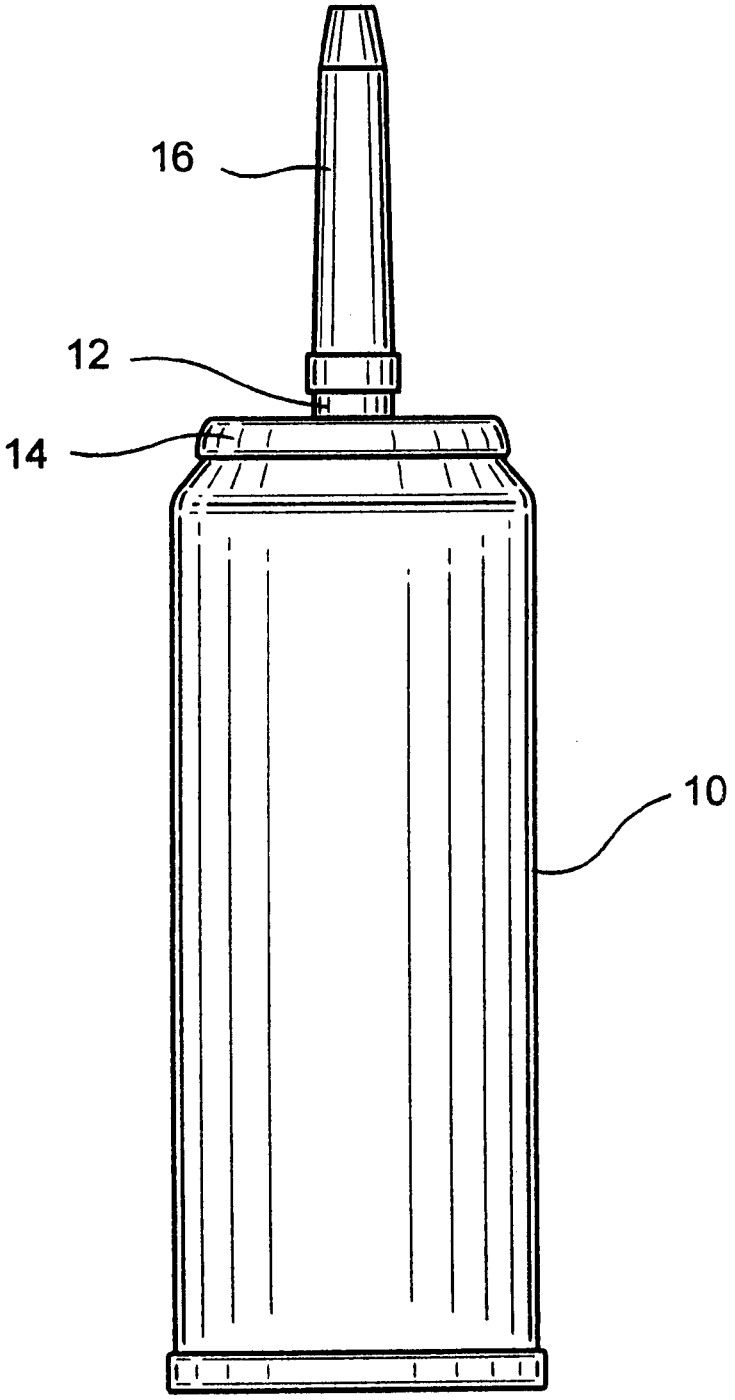
Prior Art F I G. 1
FIG. 1 is an elevational view of a typical pressurized container showing the nozzle mounted on the valve. The FIG. 1 container is of the type in which there is a valve cup but no sidewall rim on which to hang a hook.

FIG. 1 illustrates the known art and shows the device to which this invention is applied. FIG. 1 shows a pressurized container 10 having a valve 12 that extends out of a valve cup 14 and onto which the nozzle 16 is mounted.

It should be noted that there are pressurized containers in which the can itself has a rim which is radially outward of the valve cup.

This invention is described in one embodiment (FIGS. 2–4) which hangs the nozzle on the rim of the valve cup 14 and a second embodiment (FIGS. 5–7) which hangs the nozzle on rim of the container sidewall. The rim employed, whether cup rim or sidewall rim, is the one to which the container over cap is mounted.

As is known, the nozzle 16 when mounted on the valve is usually pressed in a direction perpendicular to the main axis of the can causing the valve to tilt, open and provide the material in the can through the nozzle 16 to be applied to whatever object is being worked on.

Figure 2:
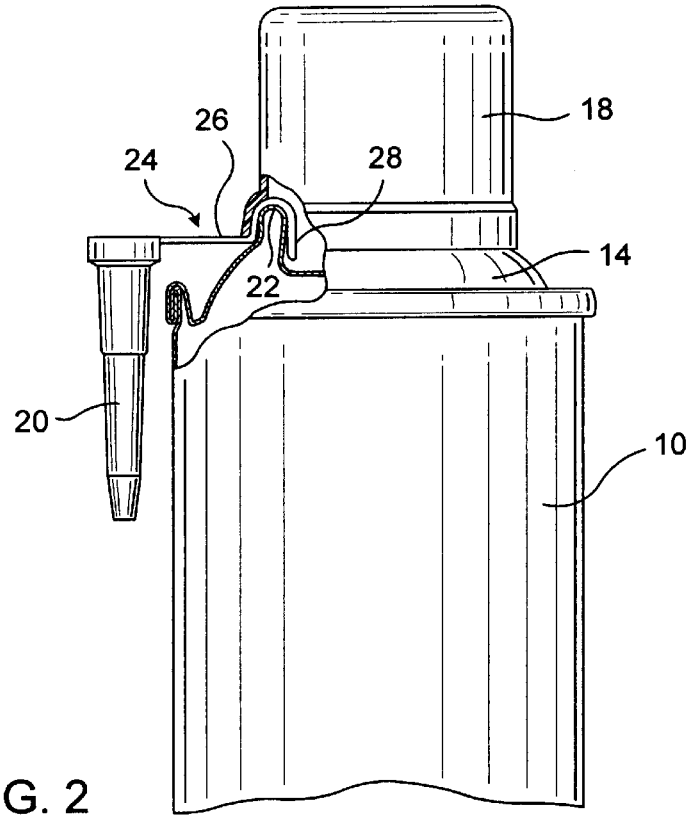
FIG. 2 is a partial sectional view of a FIG. 1 type of pressurized container showing a nozzle with a hook member in which the hook is assembled over the valve cup.

FIG. 2 shows the container 10 with the valve 14 and the over-cap 18 that is normally associated with these pressurized containers. The over-cap 18 protects the valve until it is required for use. At the time of use, the over-cap 18 is removed. In FIG. 2, the nozzle 20 is coupled to the rim 22 of the valve cup using a hook member 24 that has a leg 26 and a hook portion 28.

Figure 3:
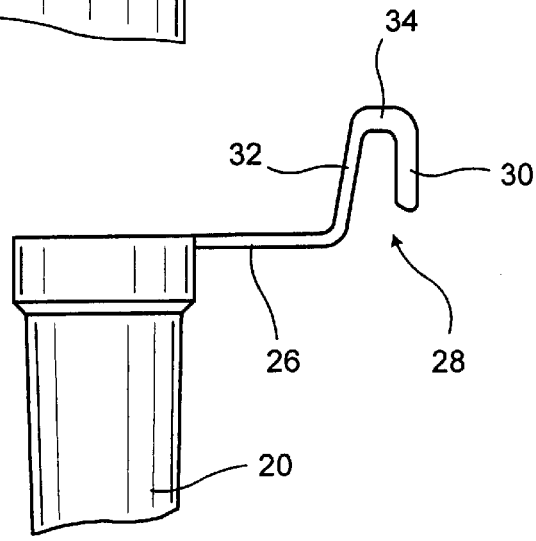
FIG. 3 shows an elevational view of the FIG. 2 nozzle and associated hook member. This is an arrangement adapted for assembly with the rim of the valve cup.
Figure 4:
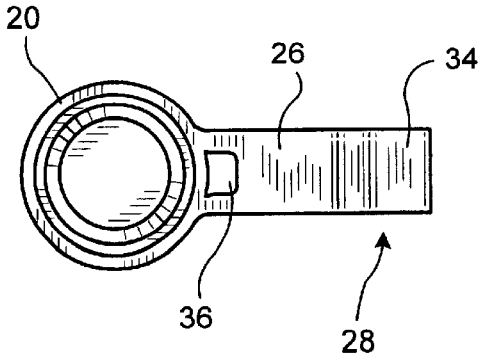
FIG. 4 shows a plan view of FIG. 3.

As may be seen from FIG. 3, the leg 26 extends radially outward from the nozzle 20 to the hook portion 28. The hook portion 28 has a first wall 30 that lies along the inside of the rim 22 of the valve cup. A second wall 32 lies along the outer portion of the valve cup rim 22. These two walls 30 and 32 are connected by a section 34 that has a length so that the hook portion 28 has a slip-fit relationship to the valve cup rim 22 with which it is associated. This slip-fit, or approximately slip-fit, relationship is important. When the over-cap 18 is placed over the hook 28 and contacts the wall 32, the wall 32 will not significantly flex. This avoids causing the nozzle 20 to flare from the position in which the nozzle axis is parallel to the axis of the can.

A second feature that will prevent the flaring of the nozzle 20 is to keep the thickness of the wall 32 as thin as possible. The hook wall 32 is relatively thin and the hook wall 30 is relatively thick. Having the hook wall 30 relatively thick provides a degree of stability for the hook portion 28.

In one embodiment, the leg segment 26 is about 140 mils (0.140 inches) in length, has a width of 190 mils and a thickness of 30 mils. In that embodiment, the two legs 30 and 32 of the hook section have a length approximately 240 mils and, importantly, the first wall 30 has a thickness of 50 mils while the second wall 32 has a thickness of 30 mils.

Figure 5:
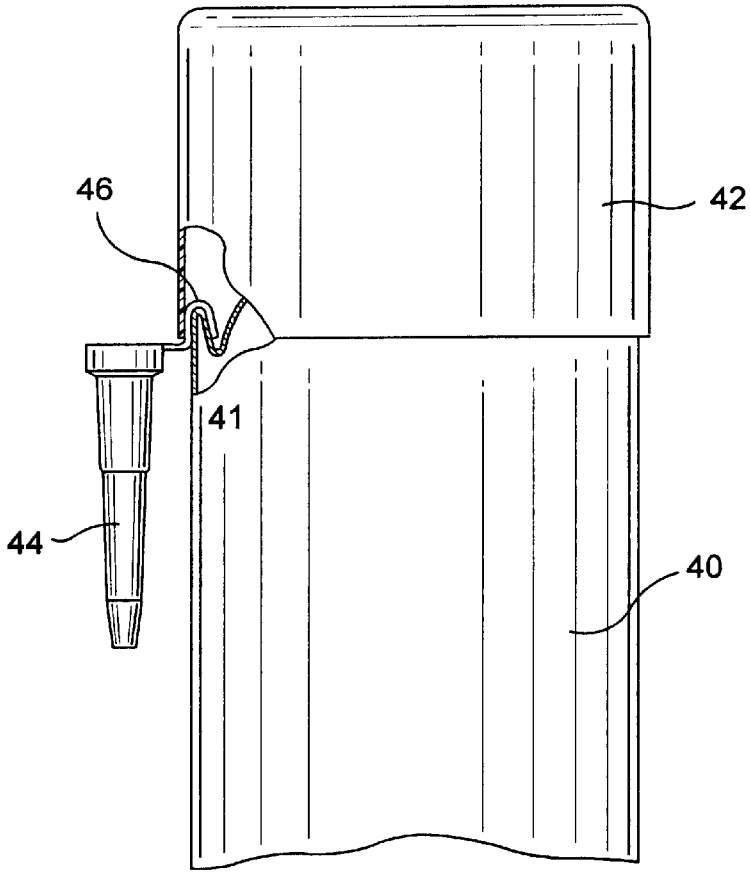
FIG. 5 is a view similar to FIG. 2 except that FIG. 5 illustrates the nozzle and associated hook assembled on the rim of the sidewall of a pressurized container.
Figure 6:
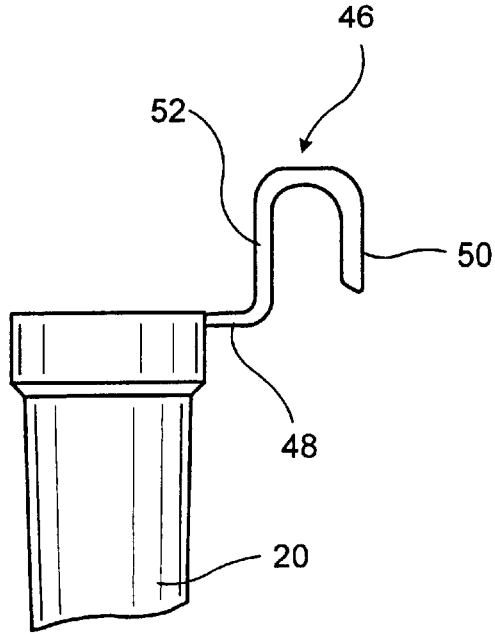
FIG. 6 is an elevational view, similar to that of FIG. 3, showing the nozzle and hook member adapted for assembly on the rim of the container sidewall.
Figure 7:
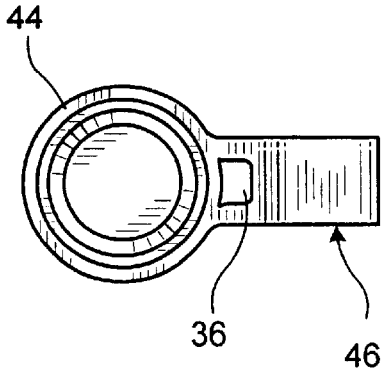
FIG. 7 is a plan view of FIG. 6.

FIGS. 5–7 shows an embodiment adapted to be employed with the rim of the container sidewall. The can 40 is shown with a rim 41 that receives the over-cap 42. In FIG. 5, the portion where the nozzle 44 is assembled to the can 40 is broken away. Except for dimensions, the design of the hook member 46 is essentially the same as in the FIG. 2 embodiment. In one FIG. 5 embodiment, the leg 48 is about 440 mils long. The walls 50, 52 of the hook are spaced to provide a slip-fit relationship to the rim 41 of the can. The hook wall 50 on the inside of the rim 41 is 50 mils thick while the hook wall 52 on the outside of the rim 41 is 30 mils thick.

In both embodiments, the nozzle 20, 44 is plastic and the plastic hook member 24, 46 is preferably molded with the nozzle.

In both embodiments, an opening 36 through the wall of the leg 26, 48 at the juncture with the nozzle 20 permits the user to readily rip off the hook member 24, 46 when the nozzle 20 is to be deployed over the valve for dispensing product.

In both embodiments, the hook member 24, 46 is 190 mils wide.

What is claimed is:

1. A nozzle assembly for packaging a nozzle with a pressurized dispensing container comprising:

a nozzle having an outer surface, a hook member extending outward from said outer surface of said nozzle, said hook member having a hook portion and a leg portion connecting said hook portion to said nozzle, said hook portion having a slip-fit type relationship to a rim to which the nozzle is intended to be hung for packaging, said hook portion having first and second opposed walls, said first wall being thicker than said second wall, said first wall, which is the thicker wall, engaging the inside of the rim and said second wall engaging the outside of the rim.

2. The nozzle assembly of claim 1 wherein said hook member is molded integral with said nozzle.

3. The nozzle assembly of claim 2 further comprising an opening through said leg portion at the junction of said leg portion with said nozzle to facilitate removal of said hook member from said nozzle.

4. The nozzle assembly of claim 1 wherein said first wall of said hook is approximately 50 mils thick and said second wall is approximately 30 mils thick.

5. The nozzle assembly of claim 4 wherein said hook member is molded integral with said nozzle.

6. The nozzle assembly of claim 5 further comprising an opening through said leg portion at the junction of said leg portion with said nozzle to facilitate removal of said hook member from said nozzle.

7. The nozzle of claim 1 wherein said leg portion is connected to one end of said nozzle.

8. The nozzle assembly of claim 7 wherein said hook member is molded integral with said nozzle.

9. The nozzle assembly of claim 8 further comprising an opening through said leg portion at the junction of said leg portion with said nozzle to facilitate removal of said hook member from said nozzle.

* * * * *